US007755509B2

(12) United States Patent
Bespalov et al.

(10) Patent No.: US 7,755,509 B2
(45) Date of Patent: Jul. 13, 2010

(54) USE OF PATTERN MATCHING TO PREDICT ACTUAL TRAFFIC CONDITIONS OF A ROADWAY SEGMENT

(75) Inventors: Dmitriy Bespalov, Philadelphia, PA (US); Ali Shokoufandeh, New Hope, PA (US)

(73) Assignee: Traffic.com, Inc., Wayne, PA (US)

( * ) Notice: Subject to any disclaimer, the term of this patent is extended or adjusted under 35 U.S.C. 154(b) by 268 days.

(21) Appl. No.: 11/869,372

(22) Filed: Oct. 9, 2007

(65) Prior Publication Data

US 2009/0079586 A1 Mar. 26, 2009

Related U.S. Application Data

(60) Provisional application No. 60/973,911, filed on Sep. 20, 2007.

(51) Int. Cl.
*G08G 1/09* (2006.01)

(52) U.S. Cl. ..... 340/905; 340/995.13; 701/204

(58) Field of Classification Search ..... None
See application file for complete search history.

(56) References Cited

U.S. PATENT DOCUMENTS 5,889,477 A * 3/1999 Fastenrath ..... 340/905
6,256,577 B1 * 7/2001 Graunke ..... 701/117
6,577,946 B2 * 6/2003 Myr ..... 701/117
2003/0225668 A1 * 12/2003 Goto et al. ..... 705/37
2005/0209772 A1 * 9/2005 Yoshikawa et al. ..... 701/200
2006/0017588 A1 * 1/2006 Hilliard ..... 340/995.13
2006/0064234 A1 * 3/2006 Kumagai et al. ..... 701/117
2006/0064235 A1 * 3/2006 Ishikawa et al. ..... 701/117
2006/0268707 A1 11/2006 Lee et al.
2006/0268736 A1 11/2006 Lee et al.
2006/0268737 A1 11/2006 Lee et al.
2007/0195700 A1 * 8/2007 Katoh et al. ..... 370/235
2007/0208501 A1 * 9/2007 Downs et al. ..... 701/119

* cited by examiner

*Primary Examiner*—Daniel Wu
*Assistant Examiner*—Brian Wilson
(74) *Attorney, Agent, or Firm*—Lisa M. Schoedel; Frank J. Kozak; Jon D. Shutter

(57) ABSTRACT

Actual traffic conditions of a roadway segment are predicted by providing a plurality of historical roadway condition patterns of the roadway segment in a database, obtaining an electronic representation of a current roadway condition pattern of the roadway segment, identifying one or more of the historical roadway condition patterns that closely matches the current roadway condition pattern, and predicting the future actual traffic conditions of the roadway segment by using the conditions associated with the one or more identified historical patterns.

19 Claims, 7 Drawing Sheets

$$d(p_1, p_2) = \frac{S_1}{S_1 + S_2}$$

USE OF PATTERN MATCHING TO PREDICT ACTUAL TRAFFIC CONDITIONS OF A ROADWAY SEGMENT

CROSS-REFERENCE TO RELATED APPLICATIONS

This application claims the benefit of U.S. Provisional patent application Ser. No. 60/973,911 filed Sep. 20, 2007.

BACKGROUND OF THE INVENTION

The widespread use of navigation devices indicates their usefulness at guiding drivers to take the shortest route (in terms of length of travel). However, the current state of technology is less adept at routing drivers based on current traffic conditions on the roadways, such as to avoid traffic jams. In order to make road navigation based on current traffic conditions possible, real-time data collection on roadway conditions would be useful. Today, it is possible to collect real-time data on roadway traffic conditions using a network of special sensors installed on roadways, toll-tag readers, and GPS data obtained from the moving vehicles. However, in order to make navigation based on current traffic conditions even more accurate, it would be useful to make short-term predictions (e.g., two hours ahead) using information on current roadway traffic conditions. Indeed, to choose the optimal route, it would be helpful to have the navigation system know what roadway traffic conditions will be like when the driver gets to a certain part of the route in the future. The disclosed system and method addresses these considerations.

BRIEF SUMMARY OF THE INVENTION

In one preferred embodiment, short-term predictions are made, such as up to two hours ahead, for roadways traffic conditions given the current state of the roadway traffic conditions. This approach relies upon the use of a prior history of roadway traffic conditions collected over an extended period of time. Compression techniques are used to operate on the vast amount of prior historical data. In addition, special processing of the history data allows for the extraction of so-called "roadway condition patterns," such as a traffic jam of a specific severity and/or length. The ability to match these "roadway condition patterns" allows the system to search the history for a closest match to the "roadway condition pattern" extracted from current roadway condition data. The closest matching "roadway condition patterns" from the history are then used to make the short-term predictions.

BRIEF DESCRIPTION OF THE DRAWINGS

The foregoing summary, as well as the following detailed description of preferred embodiments, will be better understood when read in conjunction with the appended drawings. For the purpose of illustration, the drawings show presently preferred embodiments. However, the invention is not limited to the precise arrangements and instrumentalities shown.

In the drawings.

DETAILED DESCRIPTION OF THE INVENTION

I. Definitions

Figure 1:
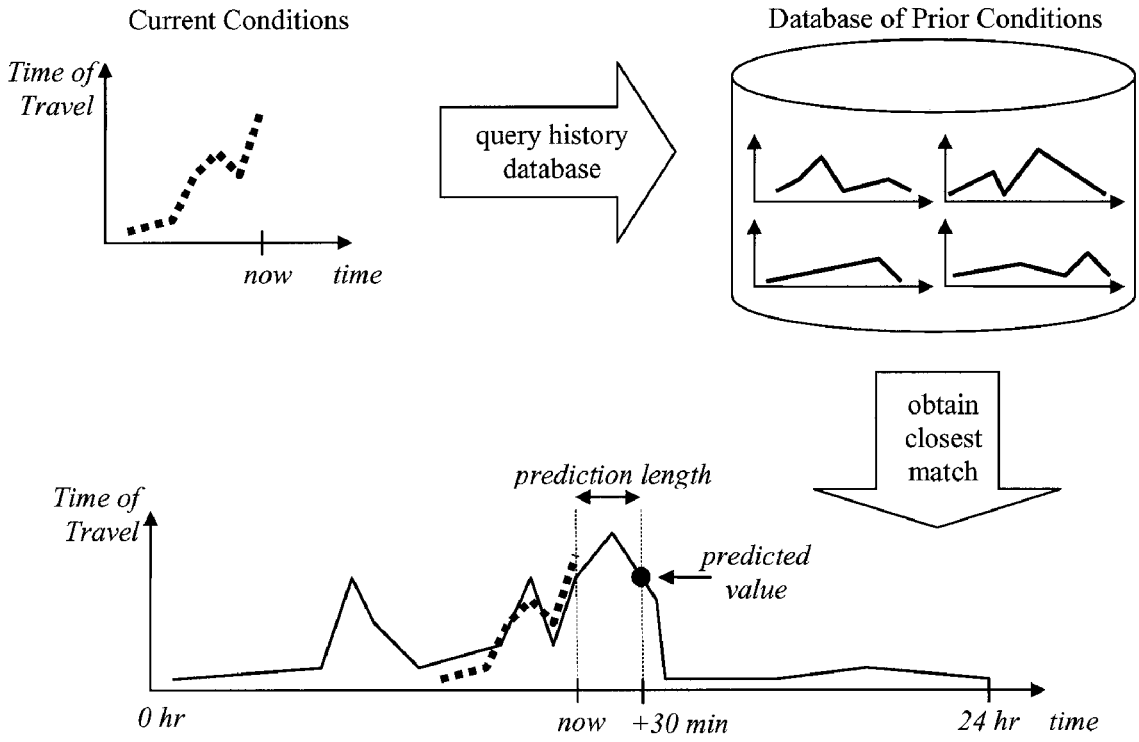
FIG. 1 illustrates the process of making predictions based on currently observed conditions and a database of historical conditions in accordance with preferred embodiments.

The following definitions are provided to promote understanding of the invention.

Roadway Segment: A segment of physical pavement of a roadway in one direction of some granularity.

Condition of Roadway Segment: Time to travel through the roadway segment at a point in time t. An average speed of travel through that segment may also be used to indicate the condition of the roadway segment.

Actual Condition of Roadway Segment: Roadway condition that is encountered by motorists traveling through the segment of the roadway.

Estimated Condition of Roadway Segment: Estimation of actual roadway condition that is produced using data obtained from sensors, toll-tag gates, GPS-enabled vehicles or traffic events.

Historical Condition of Roadway Segment: Estimated condition of a roadway segment that was encountered in the past over a period of time, and more specifically, prior roadway conditions recorded continuously at finer granularity time segments (e.g., every 1 minute or 5 minutes) for a period of 24 hours.

Traffic Event: An occurrence on the road system which may have an impact on the flow of traffic. Traffic events include congestions, incidents, weather, construction and mass transit.

Congestion: A traffic event which represents a congestion of various degrees of severity. A congestion event is usually manually identified by traffic operators and spans across a stretch of some roadway.

Incident: A traffic event which is generally caused by an event, planned or unplanned, which directly or indirectly obstructs the flow of traffic on the road system or is otherwise noteworthy in reference to traffic. Incidents are generally locatable at a specific point or across a span of points. Some examples of incidents include: accidents, congestion, disabled vehicles, debris on the roadway, traffic light malfunction, and vehicle fires among others.

Weather: A Traffic Event which describes various weather conditions which can have a traffic impact and can be oriented directly on a plurality of segments or across a region. Some examples include icy roads, rain, and sun glare.

Construction: A Traffic Event which includes planned and unplanned roadworks. This can be due to major construction, for example, adding a lane, bridgeworks, or "roving" construction crews such as litter cleanup, pothole patching, and line painting.

Mass Transit: A Traffic Event which describes conditions on buses, trains, trolleys, airports, or other forms of non passenger vehicle transit. Examples include service delays on one or more routes, and service cancellations on one or more routes.

II. Overview of a Present Embodiment

A method and apparatus are provided for estimating actual conditions of a roadway segment, and operates as follows:

III. Detailed Disclosure

1. The process of making predictions of roadway conditions using prior history data involves two sets of data for each roadway segment a prediction is produced for. The first set of data are the most recent (current) conditions data, which is continuously recorded. The second set of data is the database of historical conditions on the roadway segment. Current conditions are used to query the database of historical conditions to find historical conditions that most closely resemble current conditions. Once such historical conditions are identified, they are traversed for the length of time that the prediction should be made for and the resulting value (time of travel or average speed) is returned as a prediction value.

FIG. 1 illustrates the process of making predictions based on currently observed conditions and a database of historical conditions.

2. Storing Historical Conditions Data 2.1 Compressing Data

Storing and operating with an exact history of roadway conditions accumulated for an extended period of time (e.g., months of data) uses significant storage and system memory capacity. A data compression approach is employed to reduce the amount of storage.

For each roadway segment, data on conditions are recorded every minute. For 24 hours of data, 1440 readings are stored. These 24 hour segments of roadway condition data are replaced with connected line segments. Each line segment represent a well-known "Linear Least Squares" fit of the data that it replaces. Data compression is an iterative process. Each consecutive reading gets "added" to the current line segment if the average error of the fit with the new reading is less than a threshold $\epsilon_{avg}$. If the average error of the fit with the new reading is larger than $\epsilon_{avg}$, then a new line segment is formed using two points: the end point of the previous line segment (excluding new reading) and the new reading. When the last roadway condition reading is processed, end points (and first point of the first line segment) of all constructed line segments are saved to form piece-wise linear compression (i.e., interpolation) of the original data readings. This is done to provide that the line segments are connected to each other.

In the system implementation, readings of average travel speeds (through roadway segments) are used to capture roadway conditions. However, to simplify further predictive system modeling, roadway conditions are stored in the following form: MAX_SPEED−$S_{avg}$, where MAX_SPEED=100.0 (mph) denotes maximum possible speed of travel through the segment, and $S_{avg}$ denotes average travel speed, which is one aspect of roadway condition data. The average error threshold for linear fit was set to $\epsilon_{avg}$=0.2 (mph).

Figure 2:
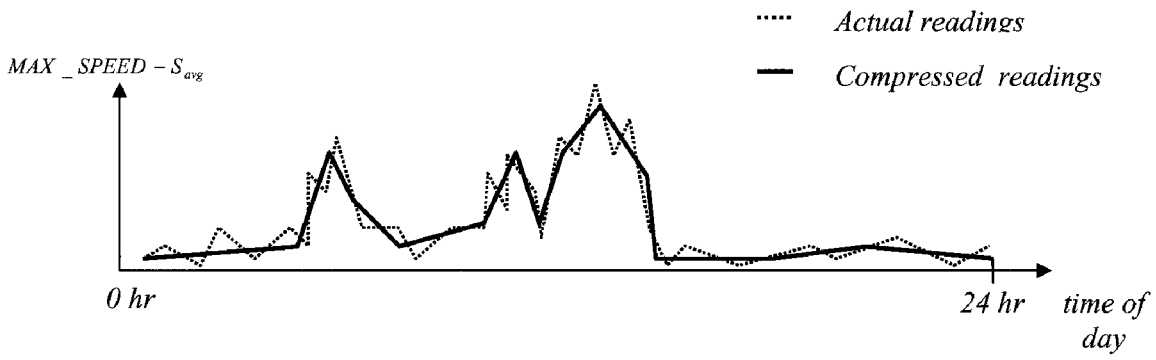
FIG. 2 illustrates the process for data compression of actual roadway condition readings in accordance with preferred embodiments.

FIG. 2 illustrates the process of data compression.

2.2 Identifying Congested Conditions

In order to efficiently operate on the history of roadway conditions, congested roadway conditions for all roadway segments are identified. For each roadway segment, a statistical threshold value $\delta_{congestion}$ for the underlying data is calculated which is used to identify congested roadway conditions for that segment. In the predictive system, historical roadway conditions are stored in the form of MAX_SPEED−$S_{avg}$ and once the congestion threshold $\delta_{congestion}$ is calculated, readings that have values that are higher than $\delta_{congestion}$ (i.e., corresponding speeds are lower) are treated as congested roadway conditions.

Figure 3:
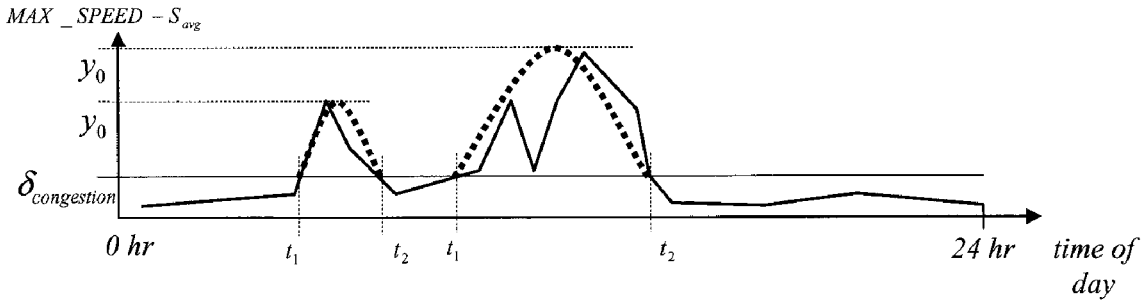
FIG. 3 shows two congestion curves created for two intervals of congested readings in a 24 hour history of roadway conditions in accordance with preferred embodiments.

FIG. 3 shows values of $\delta_{congestion}$ relative to a 24 hour history of roadway condition readings.

The process of calculating values of $\delta_{congestion}$ for each roadway segment is described next. Let $lowest_{20\%}$ denote average of 20% of the lowest roadway condition readings (MAX_SPEED−$S_{avg}$) for some roadway segment, std_dev denote standard deviation computed on the sample of all roadway condition readings. Then, the congestion threshold is defined as $\delta_{congestion}$=$lowest_{20\%}$+(std_dev·std_dev_coeff), where the coefficient is set to std_dev_coef=0.75.

2.3 Fitting Analytical Curve to Congested Conditions

For each 24 hour history of roadway conditions, segments of congested conditions are identified and an analytical curve (parabola) $y=a\cdot t^2+b\cdot t+c$, $a<0$ (t denotes minute since the start of the 24 hour history, y denotes roadway condition readings MAX_SPEED−$S_{avg}$) is fit to the corresponding congested conditions. Segments of congested conditions that are less than 45 minutes apart are grouped together. For each segment of congested conditions, the parabola ($y=a\cdot t^2+b\cdot t+c$, $a<0$) passes through two points ($t_1,\delta_{congestion}$) and ($t_2,\delta_{congestion}$), where $t_1$ and $t_2$ are minutes since the start of the 24 hour history, and roadway condition readings are $\delta_{congestion}$. Points ($t_1,\delta_{congestion}$) and ($t_2,\delta_{congestion}$) represent first and last points of a segment, from roadway condition readings, that was identified as being congested. In cases when the 24 hour history of roadway condition readings start or end with congested conditions (i.e., values greater than $\delta_{congestion}$), the first or last roadway condition reading is used as a point on the parabola curve. Finally, the constraint that uniquely identifies the parabola $y=a\cdot t^2+b\cdot t+c$, $a<0$ is: parabola value y at its vertex is set to maximum roadway condition reading value between $t_1$ and $t_2$ (denoted with $y_{max}$). Formally, the problem of constructing the parabola $y=a\cdot t^2+b\cdot t+c$ can be reduced to solving the following system of equations for a, b and c:

$$\begin{cases} \delta_{congestion} = a\cdot t_1^2 + b\cdot t_1 + c \\ \delta_{congestion} = a\cdot t_2^2 + b\cdot t_2 + c \\ y_{max} = \dfrac{4\cdot a\cdot c - b^2}{4\cdot a} \\ a < 0 \end{cases}$$

For the sake of simplicity, the analytical curve defined by $y=a\cdot t^2+b\cdot t+c$, $a<0$ between $t_1$ and $t_2$ will be referred to as a congestion parabola or curve. FIG. 3 illustrates two congestion curves created for two intervals of congested readings in a 24 hour history of roadway conditions. In addition, the same process of fitting congestion curves is applied to current readings that are determined to be congested, using $\delta_{congestion}$ computed using history of roadway conditions for the corresponding roadway segment.

2.4 Distance Measure Between Two Congestion Parabolas

Once congestion parabolas are constructed for time segments of the congested roadway condition (historical and/or current), a distance value or measure may be assigned for a given pair of congestion curves. The process of making predictions involves finding closest matches between current roadway condition patterns and historical roadway conditions patterns. In order to establish a "closest match," numerical values (real numbers) for any given pair of patterns (current and historical) are assigned. These numerical values reflect a distance measure for the corresponding pair of patterns, wherein a higher distance value means patterns are less similar or further apart. Once distance values are computed between a current pattern and all patterns from historical data, picking pairs with lowest distance values enable the system to establish historical patterns that closely resemble the current pattern.

To define a distance measure for a pair of congestion parabolas $p_1$ and $p_2$, let $A(p_1,t_1,t_2)$ denote the area under congestion curve $p_1$ between its endpoints points $t_1$ and $t_2$ and $A(p_2,t_3,t_4)$ the area under congestion curve $p_2$ between endpoints points $t_3$ and $t_4$. $A(p_1,t_1,t_2) \cup A(p_2,t_3,t_4)$ and $A(p_1,t_1,t_2) \cap A(p_2,t_3,t_4)$ denote the union and intersection of the areas defined by the congestion curves $p_1$ and $p_2$, respectively.

The distance between two congestion parabolas is defined as follows:

$$d(p_1, p_2) = \frac{(A(p_1, t_1, t_2) \cup A(p_2, t_3, t_4)) \cap (\neg (A(p_1, t_1, t_2) \cap A(p_2, t_3, t_4)))}{A(p_1, t_1, t_2) \cup A(p_2, t_3, t_4)}$$

Figure 4:
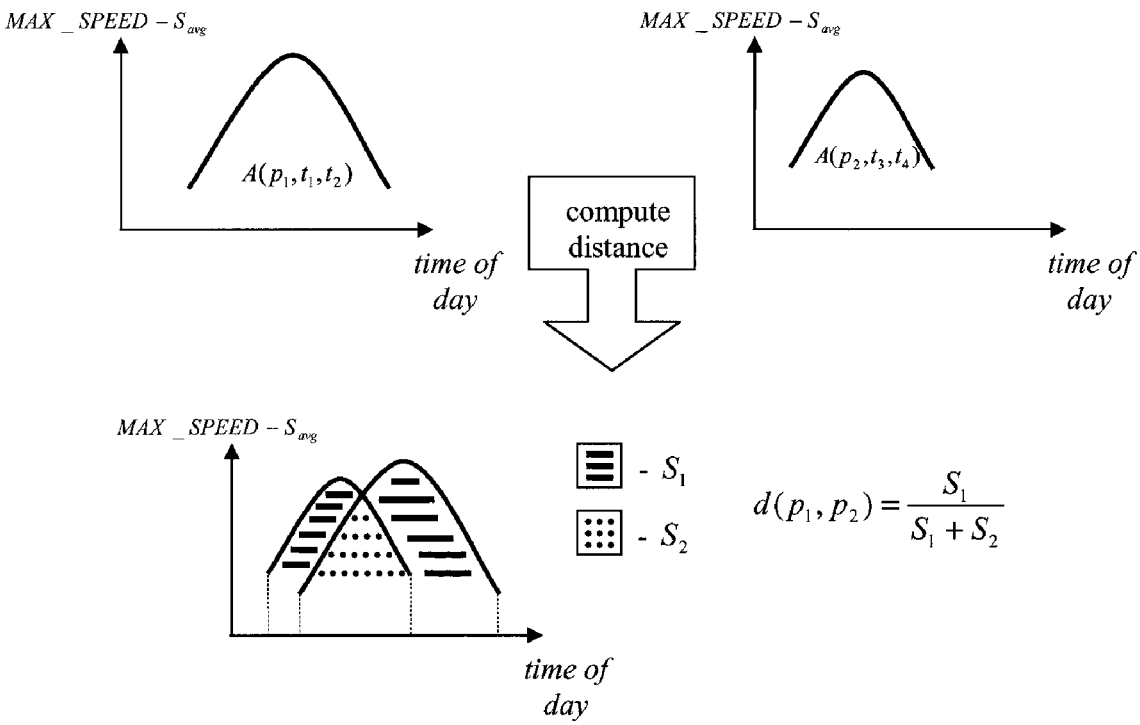
FIG. 4 illustrates a distance measure between two congestion curves in accordance with preferred embodiments.

FIG. 4 illustrates a distance measure between two congestion curves. When one of the congestion curves $p_1$ represent current roadway condition data, the distance measure takes the following form:

$$d(p_1, p_2) = \frac{(A(p_1, t_1, t_2) \cup A(p_2, t_3, \min(t_2, t_4))) \cap (\neg (A(p_1, t_1, t_2) \cap A(p_2, t_3, \min(t_2, t_4))))}{A(p_1, t_1, \min(t_2, t_4)) \cup A(p_2, t_3, \min(t_2, t_4))}$$

Not all of the historical and current roadway conditions are identified as congested (these roadway conditions will be referred to as non-congested conditions). As a result, distance values are assigned between congested and non-congested conditions. When one of the arguments in the distance function d(.,.) represents non-congested condition and the other one represents a congested condition, the distance measure is set to d(.,.)=1.0 (for both current and historical conditions).

2.5 Distance Measure Between Non-Congested Conditions

When both arguments $p_1$ and $p_2$ to the distance function $d(p_1,p_2)$ represent non-congested conditions, the distance value is assigned as follows: Let $s_1$ denote average speed for $p_1$, and $s_2$ denote average speed for $p_2$. When the current roadway condition is identified as being non-congested, average speed is computed for the last 15 minutes of the current roadway condition readings. In the case of historical data, average speed is calculated for 15 minutes of historical readings preceding the time (e.g., minute) of the day used in the calculation. Then $d(p_1,p_2)$ is defined as follows:

$$d(p_1, p_2) = \frac{|s_1 - s_2|}{\text{MAX_SPEED}},$$

where MAX_SPEED=100.0 (maximum possible speed value in mph).

2.6 Grouping Similar Congestion Parabolas

Congestion curves extracted from the history of roadway conditions are grouped together. Group information is used in the predictive system when obtaining a prediction value once the closest match between the history and the current data is established. Groups of congestion curves are constructed iteratively. A congestion curve is added to a group of congestion parabolas if the following two criteria are true:

1. The distance between the new group candidate and group_ratio percent (%) of congestion curves already in the group is less than group_threshold
2. The distance between the new group candidate and 1−group_ratio percent (%) of congestion curves already in the group is less than relaxed_group_threshold If a new candidate cannot be added to any of the existing groups of conditions, a new group is formed and that congestion curve is assigned to the new group. In the implementation of the predictive system, the parameter values are set as follows:

group_ratio=50%
group_threshold=0.25
relaxed_group_threshold=0.35

3. Predicting Roadway Conditions 3.1 Searching History for Closest Match with Current Conditions Each 24 hours of roadway condition history data is assigned with a number of parameters (i.e., feature vectors). One parameter is a "type of day" parameter. This parameter indicates which day of the week (e.g., "Mon", "Sat") the data was collected on. In addition to seven days of the week, "Holiday" type of the day is used to indicate special holidays (e.g., Thanksgiving). Another parameter indicates whether some special event took place near by the roadway segment when the 24 hours of roadway condition history data was recorded. Special event parameter can be set to "true" (special event took place) or "false" (no special even was identified). An event is considered special if it is believed to significantly influence roadway condition patterns on the day the even took place. One example of a special event would be a football game at a near-by stadium. Finally, the third parameter of the feature vector indicates weather conditions for the 24 hours of roadway condition history data. This parameter can be set to "severe" or "normal." When the parameter is set to "severe," a corresponding 24 hour history collected during a day of severe weather conditions is identified, since severe weather can significantly affect driving conditions on the roadways.

For each roadway segment, parameters in the feature vector are set to the values appropriate to the current day: today's day of the week, whether a special event is occurring on the current day near-by the roadway segment, and severity of today's weather conditions. Then, all of the 24 hours of roadway condition history data that match today's feature vector are extracted from the history. This process of matching feature vectors is called "vector-matching" of roadway condition patterns. The rest of the prediction logic will operate on the subset of the history that matches today's feature vector.

Once vector-matching process returns a set of 24 hours of roadway condition history data, congestion parabolas for the current data, as well as all of the subset of history are extracted, and the predictive system can start making predictions. Roadway conditions (congested or non-congested) that occur within the same time of the 24 hour segments as the current time of the day are identified. For each of these roadway conditions (congested or non-congested), the distance from the last congestion curve extracted from the current data is computed and placed in a "min-heap" (i.e., a data structure that maintains candidates sorted in ascending order by the distance values). If the current data has not observed congested conditions in the past 40 minutes, then the current condition is identified as being non-congested. Roadway conditions (congested or non-congested) from historical data with the three closest distance values are selected as prediction candidates. The process of assigning distance values to pairs of current and historical roadway conditions, and consecutive selection of the three pairs with smallest distance values is called "curve-matching" of the roadway condition patterns.

3.2 Making Predictions on Roadway Conditions

Once prediction candidates are identified, 24 hour segments corresponding to prediction candidates are traced for each of the prediction lengths (i.e., 15, 30, 60, . . . , 120 mins) from the current time of the day, and these values are recorded as prediction candidate values. When a prediction candidate belongs to a group of conditions, the average of the data values for that time of the day across all members of the groups is used as the prediction candidate value. A weighted average of the three prediction candidate values for each prediction length is used as the final prediction. Distance values used in picking prediction candidates are used as weights in the weighted average computation.

3.3 Making Predictions Using Extrapolated Congestion Curves

It is possible to observe congested conditions from current data, while history data for that type of the day would not contain any congested conditions for the time of the day. Whenever this scenario occurs, a congestion parabola extracted from current congested conditions is extrapolated, and the extrapolated parabola is used to search for prediction candidates. In other words, the process of searching the history for the closest match with current conditions (described in Section 3.1) is repeated, and only the extrapolated parabola is used in the distance computation instead of the congested parabola constructed from the latest current data. In addition, whenever the extrapolated parabola is constructed (history data does not contain any congestion curves for that time of the day), the extrapolated curve is used to produce the final prediction value (overrides prediction value obtained from weighted average of prediction candidate values) if the prediction time of the day for some prediction length is less than the end time of the extrapolated parabola.

The extrapolated curve is defined by the following conditions: First, the parabola passes through the point $(t_{last}, y_{last})$ which corresponds to the last current data reading that was identified as being congested. Second, the extrapolated parabola passes through the first point of current data that was identified as being congested, wherein $(t_1, \delta_{congestion})$ denote coordinates of this point. Third, the extrapolated parabola passes through the point $(t_1+l_{congestion}, \delta_{congestion})$. Parameter $l_{congestion}$ is an average of lengths of all congestion curves for that roadway segment that have vertex values greater than or equal to $y_{max}$, where $y_{max}$ denotes the maximum value among all current condition readings that were identified as being congested. The extrapolated congestion curve will be defined between $t_1$ and $t_1+l_{congestion}$. Finally, the extrapolated parabola is concave downwards (coefficient $a<0$). These four conditions uniquely define a parabola curve. The problem of constructing extrapolated congestion parabola $y=a\cdot t^2+b\cdot t+c$ can be reduced to solving the following system of equations for a, b and c:

$$\begin{cases} y_{last} = a\cdot t_{last}^2 + b\cdot t_{last} + c \\ \delta_{congestion} = a\cdot t_1^2 + b\cdot t_1 + c \\ \delta_{congestion} = a\cdot (t_1 + l_{congestion})^2 + b\cdot (t_1 + l_{congestion}) + c \\ a < 0 \end{cases}$$

Figure 5:
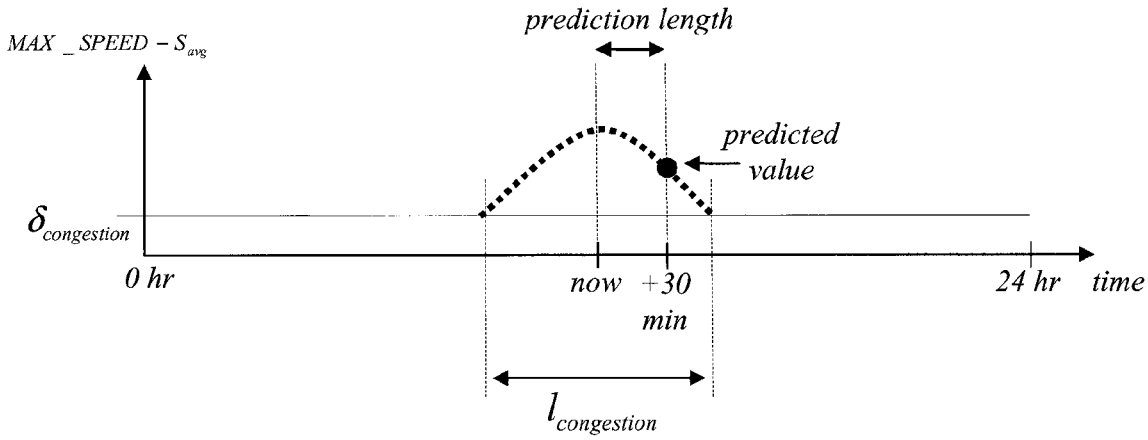
FIG. 5 shows an extrapolated congestion curve (shown in dashed lines) in accordance with preferred embodiments.

FIG. 5 illustrates the process of using an extrapolated congestion curve (shown in dashed lines) to make predictions, when no close match to current congested conditions can be found in history data.

Figure 6:
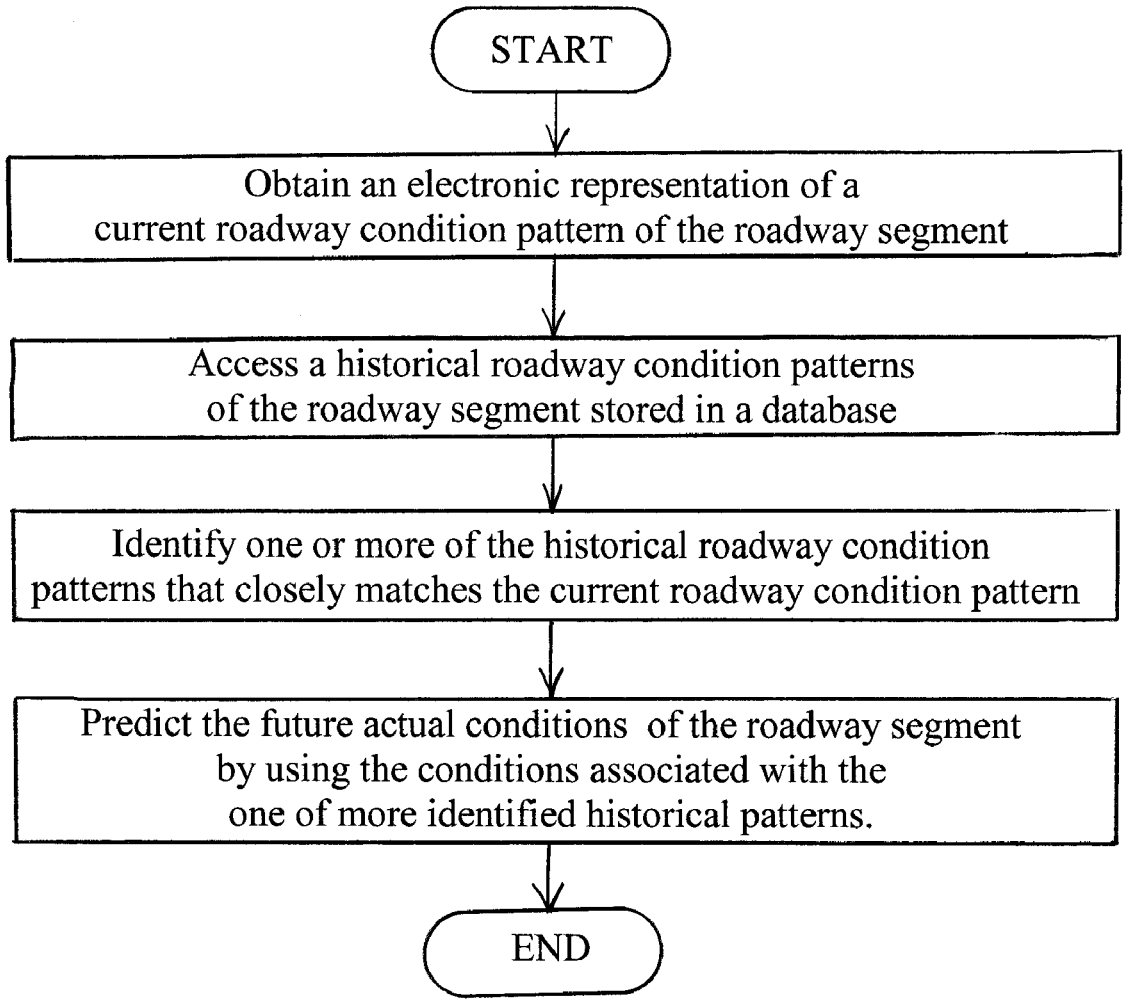
FIG. 6 shows a flowchart for implementing one preferred embodiment.

FIG. 6 shows a self-explanatory flowchart for implementing one preferred embodiment.

Figure 7:
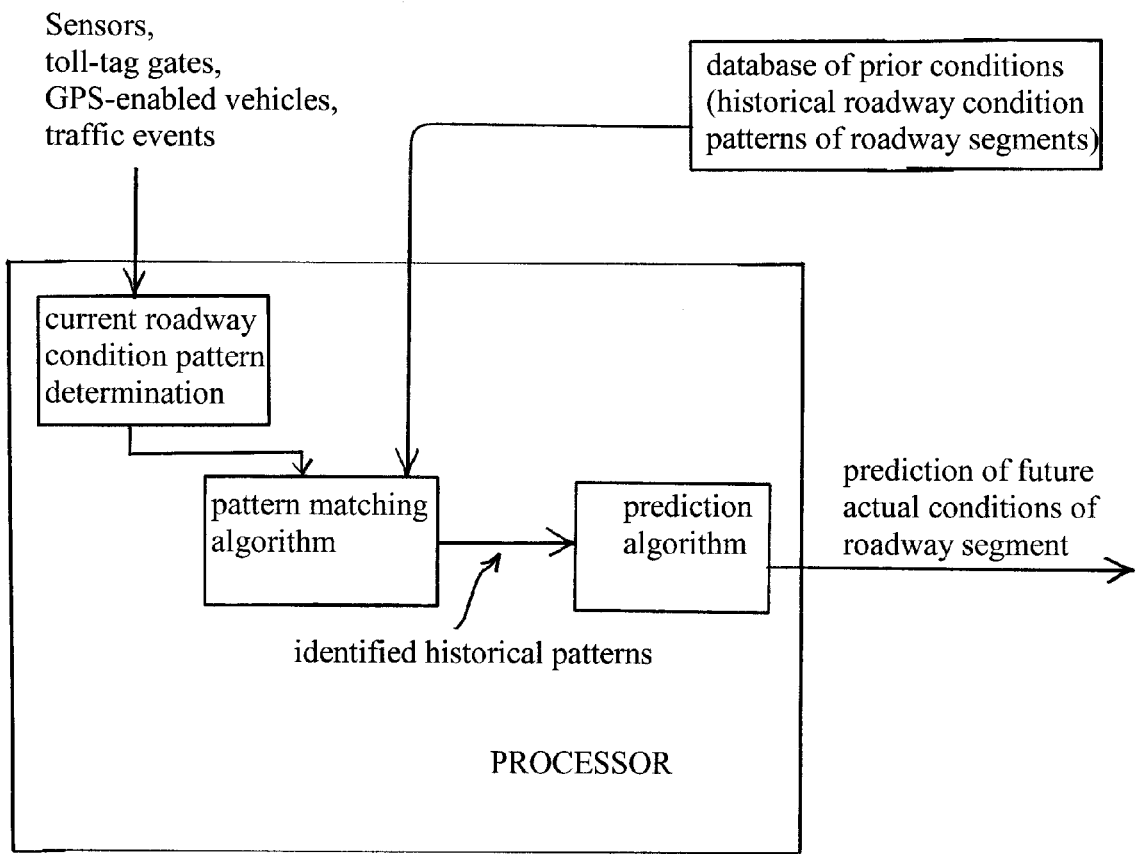
FIG. 7 shows a schematic block diagram of an apparatus for implementing one preferred embodiment.

FIG. 7 shows a self-explanatory schematic block diagram of an apparatus for implementing one preferred embodiment.

The present system and method may be implemented with any combination of hardware and software. If implemented as a computer-implemented apparatus, the system is implemented using means for performing all of the steps and functions described above.

Embodiments of the present system and method can be included in an article of manufacture (e.g., one or more computer program products) having, for instance, computer useable media. The media has embodied (encoded) therein, for instance, computer readable program code means for providing and facilitating the mechanisms of the presently disclosed system and method. The article of manufacture can be included as part of a computer system or sold separately.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A computer-implemented method for predicting traffic conditions of a roadway segment, comprising:

obtaining current roadway condition data for a roadway segment;

calculating a current congestion curve representing congestion conditions on the roadway segment using the obtained current roadway condition data;

calculating a first distance value from the current congestion curve to a previous congestion curve calculated using roadway condition data obtained most previously prior to obtaining the current roadway condition data for the roadway segment;

obtaining a second distance value from a database that is closest to the first distance value, wherein the second distance value is associated with a historical roadway condition pattern; and predicting roadway conditions for the roadway segment at a future time by tracing the historical roadway condition pattern associated with the second distance value to the future time.

2. The method of claim 1, further comprising obtaining a feature vector for the roadway segment.

3. The method of claim 2, wherein the feature vector includes parameters representing type of day, events, and weather.

4. The method of claim 2, further comprising extracting historical roadway condition patterns from the database that match the feature vector and obtaining the second distance value from the extracted historical roadway condition patterns.

5. The method of claim 1, wherein calculating a first distance includes calculating a distance between two parabolas, wherein the two parabolas represent the current congestion curve and the previous congestion curve.

6. The method of claim 1, wherein the historical roadway condition pattern is generated by:

collecting roadway condition data for the roadway segment for a period of time;

identifying congestion conditions in the collected data;

fitting a curve to the congestion conditions; and assigning a distance value to a pair of congestion curves.

7. The method of claim 6, further comprising compressing the roadway condition data for the roadway segment.

8. The method of claim 6, wherein identifying congestion conditions includes calculating a threshold value and identifying data within the collected roadway condition data that exceeds the threshold value.

9. The method of claim 8, wherein the threshold value is calculated using the formula:

$$\delta_{congestion}=\text{lowest}_{20\%}+(\text{std_dev}\cdot\text{std_dev_coeff})$$

where $\text{lowest}_{20\%}$ denotes an average of 20% of the lowest roadway condition data, std_dev denotes a standard deviation computed on the roadway condition data, and std_dev_coeff is a coefficient.

10. The method of claim 6, wherein fitting a curve to the congestion conditions includes fitting a parabola $y=at^2+bt+c$, $a<0$ to the congestion conditions.

11. The method of claim 10, wherein assigning a distance value to a pair of congestion curves includes calculating a distance between two parabolas representing congestion conditions on the roadway segment.

12. The method of claim 6, further comprising grouping similar congestion curves.

13. The method of claim 1, wherein obtaining a second distance value includes obtaining three closest distance values and predicting roadway conditions using a weighted average of three traces using three historical roadway condition patterns.

14. A computer-implemented method for predicting traffic conditions of a roadway segment, comprising:

storing historic roadway condition patterns in a database, wherein each of the historic roadway condition patterns includes at least two parabolas representing congestion conditions exceeding a threshold on a roadway segment and a distance value representing a distance between two of the at least two parabolas;

obtaining data representing current travel times for traveling through a roadway segment;

using the travel time data to calculate a current distance value;

comparing the current distance value to stored distance values to identify a historic roadway condition pattern having a closest distance value to the current distance value; and using the identified historic roadway condition pattern to predict future conditions of the roadway segment.

15. The method of claim 14, wherein using the travel time data to calculate the current distance value includes fitting congestion curves to current travel time data and assigning a numerical value to a pair of congestion curves.

16. The method of claim 15, wherein assigning a numerical value includes calculating a distance between two parabolas.

17. The method of claim 15, wherein assigning a numerical value includes setting the numerical value to 1 if one of the current travel times or the historic roadway condition pattern indicates no congestion.

18. The method of claim 15, wherein assigning a numerical value includes calculating the formula $$d(p_1, p_2) = \frac{|s_1 - s_2|}{\text{MAX_SPEED}}$$

when both the current travel times and the historic roadway condition pattern indicates no congestion, where $d(p_1,p_2)$ denotes a distance function, $s_1$ denotes average speed for $p_1$, $s_2$ denotes average speed for $p_2$, and MAX_SPEED denotes maximum speed value.

19. The method of claim 14, further comprising using a feature vector to extract a subset of the historic roadway condition patterns from the database and comparing the current distance value to extracted distance values.

* * * * *